United States Patent [19]

Amneus

[11] 3,964,670

[45] June 22, 1976

[54] CLOSURE

[75] Inventor: John Sigfrid Amneus, Cincinnati, Ohio

[73] Assignee: The Procter & Gamble Company, Cincinnati, Ohio

[22] Filed: Dec. 9, 1974

[21] Appl. No.: 530,590

[52] U.S. Cl. ..... 229/51 ST; 229/51 TS; 220/270

[51] Int. Cl.[2] ..... B65D 5/54

[58] Field of Search ..... 229/7 R, 51 R, 51 BP, 229/51 DB, 51 AS, 51 TS, 51 ST, 51 D, 51 C; 220/270

[56] References Cited

UNITED STATES PATENTS

| | | | |
|---|---|---|---|
| 1,576,088 | 3/1926 | Bunz | 229/51 DB |
| 1,714,121 | 5/1929 | Barbieri | 229/51 TS |
| 2,403,901 | 7/1946 | Belanger | 229/51 DB |
| 2,745,754 | 5/1956 | Steinbock | 229/51 AS |
| 2,776,787 | 1/1957 | Nicol | 220/359 |
| 3,090,542 | 5/1963 | Miller | 229/51 TS |
| 3,235,165 | 2/1966 | Jackson | 229/51 ST |

*Primary Examiner*—R. E. Hart
*Attorney, Agent, or Firm*—Elliot A. Lackenbach; John V. Gorman; Richard C. Witte

[57] ABSTRACT

Manually openable captive container closure comprising a cover portion of a manually tearable sheet material with high deadfold characteristics having an integral margin portion extending peripherally therearound together with means for enabling said margin portion to be attached contiguously around the mouth of a container to extend said cover portion sealingly across such container mouth, means for enabling manual opening of a perforation through a generally central region of said cover portion and means for directing manual tearing of said cover portion outwardly along a plurality of tear lines radiating from said perforation to said margin portion to separate said cover portion into a plurality of captive segments attached to said margin portion so that bunching of said segments against said margin portion provides a generally open and unobstructed fenestration substantially contermineous the container mouth.

24 Claims, 6 Drawing Figures

CLOSURE

FIELD OF THE INVENTION

This invention relates generally to closures and, more particularly, to a manually openable captive container closure.

DESCRIPTION OF THE PRIOR ART

Both captive closures and frangible closures for cans and other containers have been heretofore suggested. Much effort has also been expended on developing hermetically sealed closures for cans and other containers that may be manually opened without the use of tools.

For example, milk and other similar containers have long been provided with captive closures hinged thereto. See, e.g., Fleming U.S. Pat. No. 2,583,211 and Meyer-Jagenberg U.S. Pat. No. 2,719,663. Such captive closures, however, while suitable for liquids, and the like, which may be poured from such containers through a side of the opening opposite the hinge connection of the closure, are somewhat inconvenient and are therefore not fully acceptable for dry contents since the closure, even when opened, can interfere with access to the container mouth and must generally be manually held or restrained if to be kept totally clear of the container mouth.

Cans and similar containers, on the other hand, have long been provided with frangible, removable lids. Recently, such lids have even been designed capable of manual removal without keys or other tools. See, e.g., Fried et al. U.S. Pat. Nos. 3,195,763 and 3,195,764. Frangible and removable lids of foil and films have also been heretofore suggested. See, e.g., Betner U.S. Pat. No. 3,073,477, Fried U.S. Pat. No. 3,115,985, and Christensson U.S. Pat. No. 3,776,450 which, for example, teaches a two layer foil structure wherein the inner foil is provided with a cutline of a pointed angular form which is utilized to initiate tearing of the foil. The outer layer of foil is provided with a tongue for tearing up the foil and the base of the tongue is adhesively secured with the inner foil over the cutline to seal the cutline so that when the tongue is pulled tearing of the foil will be initiated. These patents, however, each require complete removal of a substantial portion of the closure so that the closure does not remain captive to the container and a disposal problem for the removed portion exists at the time that the container is opened. A substantial likelihood of littering by the consumer results therefrom, a result especially likely in connection with the packaging of snack and picnic type foods.

OBJECTS OF THE INVENTION

It is a primary object of the present invention to provide a closure for a can or other container which is captive, so as to avoid any problems in disposal of the closure at the time the container is opened and to thereby reduce the likelihood of the closure being improperly disposed of and contributed to littering of the environment.

It is another primary object of the present invention, in addition to the foregoing object, to provide such a closure which may be easily manually opened, without tools, to define a fenestration contermineous the container mouth and provide a full exposure through the can or container mouth without any exposed sharp edges or protruding portions.

It is still another primary object of the present invention, in addition to each of the foregoing objects, to provide such a closure which provides hermetic sealing of the container.

It is yet another primary object of the present invention, in addition to each of the foregoing objects, to provide such a closure which enables substantially open and unobstructed access through a container opening.

It is yet still another primary object of the present invention, in addition to each of the foregoing objects, to provide such closures which are economical to manufacture and apply and which are yet aesthetically appealing, hermetically tight, and durable and resistant to damage and inadvertent opening, while being susceptible to easy and convenient opening when desired.

It is still another and further primary object of the present invention, in addition to each of the foregoing objects, to provide a captive manually openable container closure of a gas and liquid impervious manually tearable sheet material with high deadfold characteristics adapted to be secured across the mouth of the container and subsequently manually torn and bunched outwardly around the container mouth to provide a generally open and unobstructed substantially full exposure through the container mouth.

The invention resides in the combination, construction, arrangement and disposition of the various conponent parts and elements incorporated in improved closures constructed in accordance with the principles of this invention. The present invention will be better understood and objects and important features other than those specifically enumerated above will become apparent when consideration is given to the following details and description, which when taken in conjunction with the annexed drawing describes, discloses, illustrates, and shows a preferred embodiment or modification of the present invention and what is presently considered and believed to be the best mode of practicing the principles thereof. Other embodiments or modifications may be suggested to those having the benefit of the teaching herein, and such other embodiments or modifications are intended to be reserved especially as they fall within the scope and spirit of the subjoined claims.

SUMMARY OF THE INVENTION

In accordance with the present invention, there is provided a manually openable captive container closure comprising a cover portion of a fluid impervious manually tearable sheet material with high deadfold characteristics having an integral margin portion extending peripherally therearound together with means for enabling said margin portion to be attached contiguously around the mouth of a container to extend said cover portion sealingly across such container mouth, means for enabling manual opening of a perforation through a generally central region of said cover portion and means for directing manual tearing of said cover portion outwardly along a plurality of tear lines radiating from said perforation to said margin portion to separate said cover portion into a plurality of captive segments attached to said margin portion so that bunching of said segments against said margin portion provides a generally open and unobstructed fenestration substantially contermineous the container mouth.

Yet further, the present invention pertains to a hermetically tight closure for a can or other container which is captive, so as to avoid any litter problems, and which may be readily and easily opened, without tools, to provide a full exposure of the can mouth without any exposed sharp edges or protruding portions. Such a closure may be fabricated, within the teaching of the present invention, of a hot melt coated deadsoft aluminum foil, heat sealed to extend hermetically across the can mouth. The hot melt is scored along diverging, preferably radial lines from a slit, cut or blanked perforation disposed, for example, at the cover center so that the foil may be readily torn along such score lines by finger pressure and pushed radially outwardly to form a plurality of segments which may be then bunched or crushed against the inside of the container mouth to provide the desired full exposure. The perforation is sealed until opening is desired by a pressure sensitive adhesive coated seal tab member of fluid impervious material having a nonadhesive appendage portion which may be grasped by a user to initiate tearing by pulling a segment of the foil outwardly from the perforation, forming an aperture sufficiently large to enable entry of the operator's fingers therein to manually tear the cover and bunch the formed segments against the margin portion.

DESCRIPTION OF THE DRAWING

While the specification concludes with claims particularly pointing out and distinctly claiming the subject matter which is regarded as forming the present invention, it is believed that the invention will be better understood from the following details and description which, when taken in conjunction with the annexed drawing, describes, discloses, illustrates and shows a preferred embodiment or modification of the present invention and wherein:

DETAILED DESCRIPTION OF THE ILLUSTRATED EMBODIMENT

Figure 1:
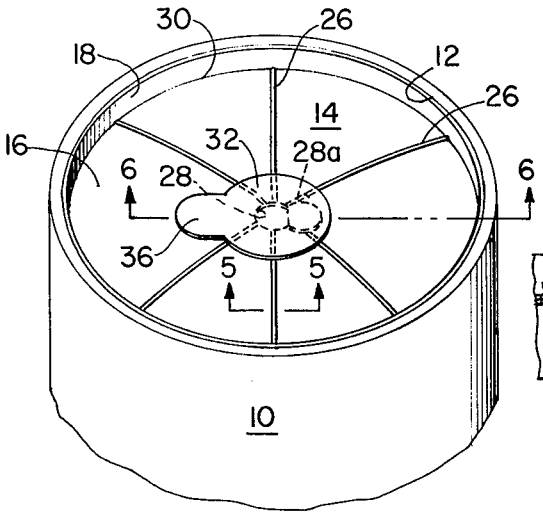
FIG. 1 is a perspective illustration of an end portion of a can provided with a closure in accordance with the present invention.
Figure 5:
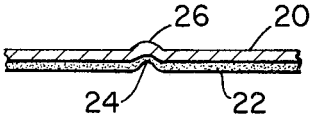
FIG. 5 is an enlarged partial cross sectional illustration taken along line 5—5 of FIG. 1.
Figure 6:
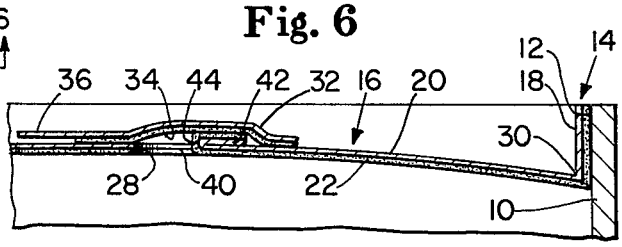
FIG. 6 is an enlarged partial cross sectional illustration taken along line 6—6 of FIG. 1.

With reference now to the drawing there is shown and illustrated therein an end portion of a can or container designated generally by the reference character 10 having a generally open and unobstructed mouth 12 together with a manually openable captive container closure extending hermetically sealingly thereacross and designated generally by the reference character 14.

The closure 14 comprises a cover portion 16 of a manually tearable fluid impervious sheet material with high deadfold characteristics and a margin portion 18 integrally formed therewith and extending peripherally entirely therearound.

As used herein the term "deadfold" refers to the quality of a material defining its ability to be bent, folded, crushed or bunched easily and its tendency to spring back from such folded, bunched or crushed configuration. The quality is related to yield point and a high deadfold material is easily bent, folded, crushed and bunched and has little or no tendency to spring back from such bending, folding, crushing or bunching while a low deadfold material is hard to bent, fold, crush or bunch and even after bending, folding, crushing or bunching tends to spring back or rebound from such condition. A high deadfold material, therefore, has a low yield point, a low elastic limit, little resistance to bending and tends to remain in any configuration without spring or rebound and is soft, easily deformed and highly plastic.

Lead foil, for example, has exceedingly high deadfold characteristics, as does aluminum foil annealed to a "dead soft" condition.

The sheet material defining the cover portion 16 and the margin portion 18 preferably comprises a layered structure comprising a metallic foil layer 20 of, for example, aluminum foil of, for example, approximately ½ to 5 mils thickness, and preferably approximately 1–3 mils thickness annealed to a "dead soft" condition coated on its lower surface by a substantially continuous polymer coating layer 22 preferably of a thermoplastic material. Hence, the layer 20, being a metallic foil may be considered to be a high melting point layer and the layer 22, being of a thermoplastic material, can be considered a lower melting point material. The thermoplastic layer 22 may, for example, comprise a hot melt adhesive and may be selected to be nonreactive to the contents of the container 10 and heat sealable to the container 10. The foil layer 20, moreover, forms a gas and moisture barrier while the polymer layer 22 prevents reaction, flavor absorption, or the like of the contents of the container with the foil 20. The layer 22 may, as will be readily apparent to those being skilled in the packaging arts, comprise a plurality of polymer layers, or one or more layers of ionomers, resins, waxes, gums, adhesives, etc.

The margin portion 18 may, as shown, comprise an upwardly turned rim of generally annular configuration with the metallic foil layer 20 exposed generally inwardly and the hot melt layer 22 exposed generally outwardly for sealing to the container 10 contiguously across the mouth opening 12 of the container 10, as by being sealed therewithin.

The hot melt layer 22 may extend substantially entirely subjacent the metallic foil layer 20 and may be provided with a plurality of outwardly radiating lines of decreased thickness 24 to define a plurality of tear lines for the sheet material of the cover portion 16 generally weaker than the remaining surface of the cover portion 16. The lines of decreased thickness 24 may be scored or may be impressed into the layer 22, as by means of a hot die tool. Further, as shown, the lines 24 may be embossed deeply into the layer 22 so as to also emboss into the layer 20 defining score lines 26 therein.

The lines 24 and 26 radiate, as shown, from a perforation 28 which may be slit, cut or blanked through the cover portion 16. The perforation 28, together with the lines 24 and 26 accordingly divide the cover portion 16 into a plurality of segments each of which is attached along a base edge 30 permanently with the margin portion 18 and tearably connected with each other along the tear lines 24 and score lines 26.

The perforation 28 is closed by means of a manually peelable seal tab 32 fabricated of a flexible material having a sealing portion which is coated, on its underside, with a pressure sensitive peelable adhesive layer 34. The seal tab 32 further comprises a nonadherent appendage portion 36 providing means for manually grasping the seal tab 32 and peeling it from across the perforation 28.

Figure 3:
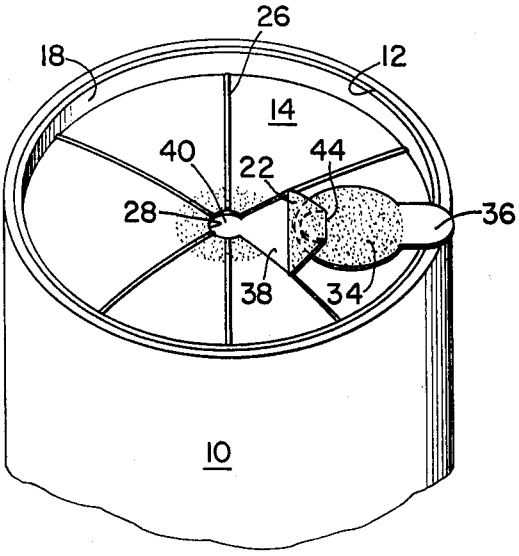
FIG. 3 is another perspective illustration similar to the preceding figures showing a further step in the opening and manipulation of the closure of the present invention.
Figure 4:
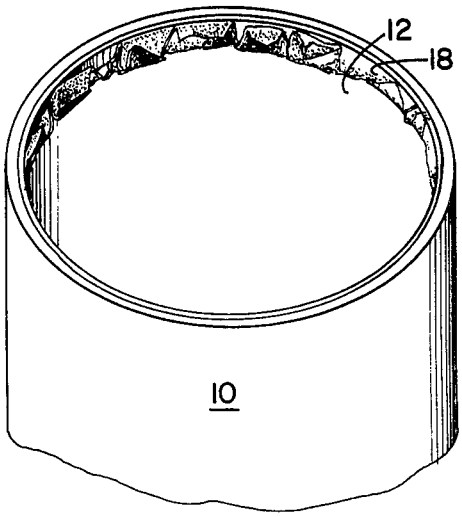
FIG. 4 is still another perspective illustration similar to the preceding figures showing the container and captive closure of the present invention with the closure in the full open configuration thereof.

The seal tab 34 is preferably adhered to one of the segmental portions of the cover 16 in such a manner that upon being peeled from across the perforation 28 continued pulling on the seal tab 32 tears the cover portion along the tear lines 26 defining the adhered segmental portion (as shown in FIG. 3) to provide an aperture 38 extending from the perforation 28, the aperture 38 being sufficiently large to enable the operator or consumer to insert a finger therethrough and outwardly tear the remaining cover portion into additional segments along the tear lines 24 and bunch each of the segments against the margin portion 18 to define a fenestration contermineous the mouth opening 12 of the container 10 and generally open and unobstructed access to the interior of the container 10, as shown in FIG. 4.

The seal tab 34 is preferably fluid impervious so as to enable hermetic sealing of the perforation 28 and may comprise, for example, metalized myler of, for example, 5–10 mil thickness.

Figure 2:
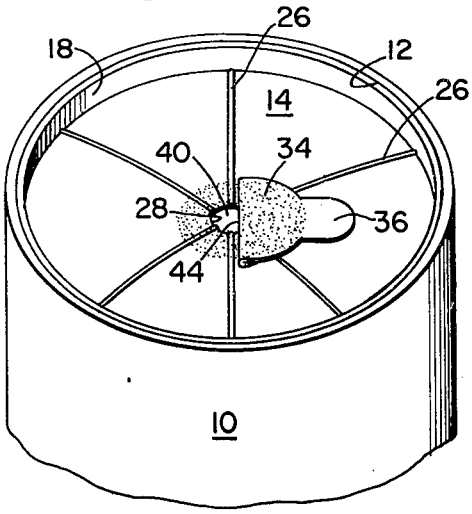
FIG. 2 is a perspective illustration similar to FIG. 1 showing a step in the opening and manipulation of the closure of the present invention.

The adherence of the seal tab 34 to one of the segmental portions of the cover 16 may conveniently be achieved by the structure shown in the drawing wherein the perforation 28 is of generally U-shaped configuration to define a notch 40 and a complimentary tongue-like flap 42 hingedly connected along a base edge 44 with the cover portion 16 defining a chordal edge to the notch 40. The tongue-like flap 42 is bent along the base edge 44 through approximately 180° to extend superjacent the cover portion 16 adjacent the notch 40 so that the polymer layer 22 of the flap 42 is exposed upwardly. The seal tab 32 is extended thereover so as to be adhered thereto. The adhesive coating 34 of the seal tab 32 may be selected to be nonpeelably adherent to the polymer layer 22 while peelably adherent to the foil layer 20. By "nonpeelably" it is merely meant that the strength of the adhesive and the bond formed thereby is greater than the tear strength of the weakened lines of the cover portion 16. Hence, upon peeling of the seal tab 32, as shown in FIGS. 2 and 3, the seal tab 32 will be peeled away from the foil layer 20 but, upon the hinge line 44 being reached, the cover portion 16 will tear along the tear lines 24, which extend outwardly of the end portions of the hinge line 44, being directed therealong by the sharp discontinuity and which raises the stress at the juncture of the perforation 28 with the ends of the hinge line 44.

If desired, the perforation 28 may be provided with short slits **28*a* extending into the tear lines 24 at the end portions of the hinge line 44. Then, it is not necessary that the adhesive coating 34 may be specifically formulated to bond more tightly with the polymer layer 22 since after the inner end portion of the adhered segment has been bent rearwardly the length of the slit 28*a*, the stress on the bond during further pulling of the tab 32 will be in shear, rather than peel, and the strength of the bond under these conditions would be stronger. The shear strength, in this case need still, however, exceed the tear strength of the weakened lines of the cover portion 16.**

Upon continued pulling on the seal tab 32, the segment defined between the tear lines 24 radiating from the end portions of the hinge line 44 may be torn from the cover portion 16 outwardly therealong to provide an aperture 38 through which a consumer's or operator's finger may be inserted to tear the cover portion 16 into the remaining segments along the remaining tear lines 24. The various segments, including the segment to which the seal tab 32 is attached may then be bunched along their marginal edges against the margin portion 18, to provide a generally open and unobstructed fenestration conterminous the mouth 12 of the container 10 as shown in FIG. 4.

While the invention has been described, disclosed, illustrated and shown in terms of an embodiment or modification which it has assumed in practice, the scope of the invention should not be deemed to be limited by the precise embodiments or modifications herein described, disclosed, illustrated or shown, such other embodiments or modifications as may be suggested to those having the benefit of the teachings herein being intended to be reserved especially as they fall within the scope and spirit of the claims here appended.

What is claimed is:

1. Manually openable captive container closure comprising, in combination, a cover portion of a manually tearable sheet material with high deadfold characteristics having an integral margin portion extending peripherally therearound together with means for enabling said margin portion to be attached contiguously around the mouth of a container to extend said cover portion sealingly across such container mouth, means for enabling manual opening of a perforation through a generally central region of said cover portion and means for directing manual tearing of said cover portion outwardly along a plurality of tear lines radiating from said perforation to said margin portion to separate said cover portion into a plurality of captive segments attached to said margin portion so that bunching of said segments against said margin portion provides a generally open and unobstructed fenestration substantially contermineous the container mouth.

2. Closure defined in claim 1 wherein said sheet material comprises at least a high melting point layer and a lower melting point layer subjacent thereto, said lower melting point layer comprising a hot melt adhesive defining said margin portion attaching means.

3. Closure defined in claim 2 wherein said lower melting point layer comprises outwardly radiating lines of decreased thickness providing lines of weakening of said sheet material to define said means for directing tearing along said tear lines.

4. Closure defined in claim 2 wherein said margin portion comprises a generally upstanding rim wall formed of said sheet material so that said hot melt adhesive is laterally outwardly exposed for adhesion within a complementary container wall defining such container's mouth.

5. Closure defined in claim 4 wherein said lower melting point layer comprises outwardly radiating lines of decreased thickness providing lines of weakening of said sheet material to define said tear lines.

6. Closure defined in claim 5 wherein said means for opening said aperture comprises a perforation extending through said central region of said sheet material, a flexible seal tab covering said perforation and means for peelably adhering said seal tab with said cover portion across said perforation, said seal tab comprising a nonadherent appendage portion manually graspable for lifting and peeling movement of said seal tab from across said perforation.

7. Closure defined in claim 6 wherein there is further provided means for adhering said seal tab with said sheet material on one side of said perforation within a pair of said tear lines so that pulling thereon opens one of said segments for bunching against said margin portion with said seal tab remaining attached thereto and to form an aperture enabling insertion of an operator's finger therethrough for manual tearing, opening and bunching against said margin portion of the remainder of said cover portion.

8. Closure defined in claim 7 wherein said perforation is of generally U-shaped configuration to define a notch and a complementary tongue-like flap hingedly connected along a base edge with said cover portion, said flap being bent about said base edge through approximately 180° to extend superjacent said cover portion adjacent said notch with the lower melting point layer of said flap portion being exposed upwardly of the higher melting point layer of said cover portion, said seal tab being adhered with said exposed lower melting point layer of said flap so as to remain captive therewith upon peeling of said seal tab from said cover portion to define said means for adhering said seal tab so that pulling thereon opens one of said segments.

9. Closure defined in claim 8 wherein an adjacent pair of said tear lines radiate from opposite ends of said flap base edge and said perforation is extended into a pair of slit portions extending into said tear lines so that pulling of said tab turns a central portion of said segment defined therebetween through approximately 180° for placing the adhesive bond between said tab and said flap in shear so that said seal tab and said flap remain attached together during pulling of said seal tab.

10. Closure defined in claim 2 wherein said means for opening said aperture comprises a perforation extending through said central region of said sheet material, a flexible seal tab covering said perforation and means for peelably adhering said seal tab with said cover portion across said perforation, said seal tab comprising a nonadherent appendage portion manually graspable for lifting and peeling movement of said seal tab from across said perforation.

11. Closure defined in claim 10 wherein there is further provided means for adhering said seal tab with said sheet material on one side of said perforation within a pair of said tear lines so that pulling thereon opens one of said segments for bunching against said margin portion with said seal tab remaining attached thereto and to form an aperture enabling insertion of an operator's finger therethrough for manual tearing, opening and bunching against said margin portion of the remainder of said cover portion.

12. Closure defined in claim 10 wherein said perforation is of generally U-shaped configuration to define a notch and a complementary tongue-like flap hingedly connected along a base edge with said cover portion, said flap being bent about said base edge through approximately 180° to extend superjacent said cover portion adjacent said notch with the lower melting point layer of said flap portion being exposed upwardly of the higher melting point layer of said cover portion, said seal tab being adhered with said exposed lower melting point layer of said flap so as to remain captive therewith upon peeling of said seal tab from said cover portion to define said means for adhering said seal tab so that pulling thereon opens one of said segments.

13. Closure defined in claim 12 wherein an adjacent pair of said tear lines radiate from opposite ends of said flap base edge and said perforation is extended into a pair of slit portions extending into said tear lines so that pulling of said tab turns a central portion of said segment defined therebetween through approximately 180° for placing the adhesive bond between said tab and said flap in shear so that said seal tab and said flap remain attached together during pulling of said seal tab.

14. Closure defined in claim 13 wherein said higher melting point layer comprises a metallic foil and said lower melting point layer comprises a hot melt coating extending substantially entirely subjacent thereto.

15. Closure defined in claim 13 wherein said lower melting point layer comprises outwardly radiating lines of decreased thickness providing lines of weakening of said sheet material to define said tear lines.

16. Closure defined in claim 13 wherein said margin portion comprises a generally upstanding rim wall formed of said sheet material so that said hot melt adhesive is laterally outwardly exposed for adhesion within a complementary container wall defining such container's mouth.

17. Closure defined in claim 1 wherein said means for opening said perforation comprises a flexible seal tab covering said perforation and means for peelably adhering said seal tab with said cover portion across said perforation, said seal tab comprising a nonadherent appendage portion manually graspable for lifting and peeling movement of said seal tab from across said perforation.

18. Closure defined in claim 17 wherein there is further provided means for adhering said seal tab with said sheet material on one side of said perforation within a pair of said tear lines so that pulling thereon opens one of said segments for bunching against said margin portion with said seal tab remaining attached thereto and to form an aperture enabling insertion of an operator's finger therethrough for manual tearing, opening and bunching against said margin portion of the remainder of said cover portion.

19. Closure defined in claim 18 wherein said perforation is of generally U-shaped configuration to define a notch and a complementary tongue-like flap hingedly connected along a base edge with said cover portion, said flap being bent about said base edge through approximately 180° to extend superjacent said cover portion adjacent said notch with the lower melting point layer of said flap portion being exposed upwardly of the higher melting point layer of said cover portion, said seal tab being adhered with said exposed lower melting point layer of said flap so as to remain captive therewithin upon peeling of said seal tab from said cover portion to define said means for adhering said seal tab so that pulling thereon opens one of said segments.

20. Closure defined in claim 19 wherein an adjacent pair of said tear lines radiate from opposite ends of said flap base edge and said perforation is extended into a pair of slit portions extending into said tear lines so that pulling of said tab turns a central portion of said segment defined therebetween through approximately 180° for placing the adhesive bond between said tab and said flap in shear so that said seal tab and said flap remain attached together during pulling of said seal tab.

21. Closure defined in claim 1 wherein said sheet material comprises at least a metallic foil and a thermoplastic coating on the bottom side thereof.

22. Closure defined in claim 21 wherein said thermoplastic layer comprises lines of decreased thickness radiating outwardly of said aperture location providing lines of weakening of said sheet material to define said means for directing manual tearing along said tear lines.

23. Closure defined in claim 22 wherein said means for opening said perforation comprises a flexible seal tab covering said perforation and means for peelably adhering said seal tab with said cover portion across said perforation, said seal tab comprising a nonadherent appendage portion manually graspable for lifting and peeling movement of said seal tab from across said perforation.

24. Closure defined in claim 23 wherein there is further provided means for adhering said seal tab with said sheet material on one side of said perforation within a pair of said tear lines so that pulling thereon opens one of said segments for bunching against said margin portion with said seal tab remaining attached thereto and to form an aperture enabling insertion of an operator's finger therethrough for manual tearing, opening and bunching against said margin portion of the remainder of said cover portion.

* * * * *